United States Patent [19]

Seni et al.

[11] 3,933,657

[45] Jan. 20, 1976

[54] LUBRICANT WITH SYNERGISTIC EXTREME PRESSURE ADDITIVES

[75] Inventors: Leonard S. Seni; Arnold C. Witte; Richard L. Coleman, all of Port Arthur, Tex.

[73] Assignee: Texaco Inc., New York, N.Y.

[22] Filed: Sept. 12, 1974

[21] Appl. No.: 505,432

[52] U.S. Cl. ..... 252/29; 252/25; 252/33.6; 252/59

[51] Int. Cl.[2] ..... C10M 1/10; C10M 3/02; C10M 5/02; C10M 7/02

[58] Field of Search ..... 252/25, 29, 33.6, 59

[56] References Cited

UNITED STATES PATENTS 3,770,634 11/1973 Dodson et al. ..... 252/29

3,844,955 10/1974 Green ..... 252/25

*Primary Examiner*—Delbert E. Gantz
*Assistant Examiner*—I. Vaughn
*Attorney, Agent, or Firm*—T. H. Whaley; C. G. Ries; Kenneth R. Priem

[57] ABSTRACT

A grease may be made having synergistic extreme pressure properties using a major amount of a base oil and a thickener and a minor amount of low density polyethylene and known extreme pressure enhancing additives.

9 Claims, No Drawings

LUBRICANT WITH SYNERGISTIC EXTREME PRESSURE ADDITIVES

BACKGROUND OF THE INVENTION

1. Field of the Invention

This invention pertains to the field of lubricants, especially greases.

2. DESCRIPTION OF THE PRIOR ART

It is desirable in the selection of greases to consider the environment that the grease will have to operate under and in many cases to select a grease which has properties which will allow it to perform adequately where two surfaces come together with considerable force. A lubricant between these surfaces must possess a property known as Extreme Pressure (EP) Tolerance. This property allows the lubricant to continue to lubricate the two surfaces and to stay between the two surfaces even though the surfaces come together with considerable force making it very difficult to keep a lubricant in place and to keep the two surfaces from actually touching each other. The art has many references to additives which impart extreme pressure properties to greases, that is the extreme pressure properties of the resulting grease having the combination of additives as disclosed by applicants have extreme pressure properties superior to greases containing either component of the proposed additive combination. In general, the additive combination of applicants' invention consists of low density polyethylene and a conventional extreme pressure additive. The low density polyethylene is melted into the grease and the combination imparts a synergistic effect to the extreme pressure properties of the resulting grease. Polyethylene has been used and is disclosed in the art for other purposes. U.S. Pat. No. 3,432,431 discloses a grease having improved endurance properties, which is not related to extreme pressure properties, wherein a high density polyethylene is cold dispersed, not melted, into a grease. Extreme pressure properties are not discussed. In fact the high density type of polyethylene used is not suitable for applicants' invention. The only mention of extreme pressure properties comes in a general listing of other additives which the patentee says may be used in his grease. One of these additives, molybdenum disulfide, is known to be used as an extreme pressure additive. However, the teachings of this patent do not discuss extreme pressure properties and the reference to molybdenum disulfide is only used in a general listing of other additives. Also, patentee uses high density polyethylene which is cold dispersed unlike the low density polyethylene which is melted, hot dispersed, in applicants' invention.

U.S. Pat. No. 3,753,906 discloses a brake cylinder grease which by the definition of the numerated properties does not have extreme pressure properties. In this patent a medium density polyethylene is melted into grease to thicken it. The only reference to extreme pressure properties is in a general and broad listing of other additives wherein the term "extreme pressure agents" appears. However, no details are given in this instance and no teaching is given to indicate that any extreme pressure properties are needed or desired in the grease disclosed and claimed, nor is there any teaching of synergism at all. In fact, extreme pressure properties are not even measured in the grease which is claimed. The general thrust of this patent is in the order of addition of the polyethylene and the clay and the effect of the order of addition on the endurance test which provides the improvement of the grease. Further, medium density polyethylene is required whereas low density polyethylene is required for the present invention.

Applicants on the other hand, have as an object the production of a grease having synergistic mixture of additives which impart extreme pressure agent. The low density polyethylene is melted into the grease.

SUMMARY OF THE INVENTION

The invention is a grease comprising a major amount of a lubricating oil, a thickener, low density polyethylene and conventional extreme pressure agents.

DESCRIPTION OF THE PREFERRED EMBODIMENT

The lubricating oils forming the major component of the grease compositions may be any lubricating oils having Saybolt Universal viscosities in the range from about 75 seconds at 100°F (75 SUS/100°F) to about 225 seconds at 210°F, which may be either naphthenic or paraffinic in type or blends comprising both naphthenic and paraffinic oils. The preferred lubricating oils are those having Saybolt Universal viscosities in the range from about 300 seconds at 100°F to about 100 seconds at 210°F, which may be blends of lighter and heavier oils in the lubricating oil viscosity range. Synthetic lubricating oils, which may be preferred in preparing greases having special properties required for special types of lubricating service, include oils prepared by cracking and polymerizing products of the Fischer-Tropsch process and the like as well as other synthetic oleaginous compounds such as polyethers, polyester, silicone oils, etc. having viscosities within the lubricating oil viscosity range. Suitable polyethers include particularly polyalkylene glycols such as polyethylene glycol. Suitable polyesters include the aliphatic dicarboxylic acid diesters, such as di-2-ethyl-hexyl sebacate, di (secondary amyl) sebacate, di-2-ethyl-hexyl azelate, di-iso-octyl adipate, etc. The sulfur analogs of the polyalkylene esters and polyesters are also suitable.

Silicone polymer oils may also be employed, preferably having viscosities in the range from about 70 to 900 seconds Saybolt Universal at 100°F. Suitable compounds of this type include dimetyl silicone polymer, diethyl silicone polymer, methyl cyclohexyl silicone silicone polymer, diphenyl silicone polymer, methylethyl silicone polymer, methyltolyl silicone polymer, etc. The lubricating oils normally comprise from about 70 to 98% of the grease composition.

Generally two types of thickeners for the oils are used to form greases: soaps and/or clays.

By the term "soap-base thickening agent" as used herein, is meant metal soaps of fatty acids which are capable of providing a stable gel structure to lubricating base oils. The term is intended to include conventional metal soaps. complex soaps, mixed base soap greases, and the like, and include the following particular types of soap thickeners:

Metal base:

- Aluminum base
- Barium base
- Calcium base
- Lithium base
- Sodium base
- Lead base
- Strontium base Mixed bases:
- Sodium-calcium base
- Sodium-barium base
- Calcium-aluminum base
- Sodium-aluminum base
- Magnesium-aluminum base
- Lithium-aluminum base
- Lithium-calcium base Metal complex;
- Hydrated calcium soap
- Hydrated aluminum soap
- Hydrated barium soap
- Hydrated lithium soap
- Hydrated sodium soap
- Hydrated strontium soap
- Complex aluminum soap
- Complex barium soap
- Aluminum-barium complex
- Aluminum-sodium complex
- Complex calcium soap
- Calcium soap-calcium acetate complex
- Calcium soap-calcium chloride complex
- Calcium soap-strontium hydrate complex
- Calcium-barium soap complex
- Complex lithium soap
- Lithium soap-lithium acetate
- Lithium soap-lithium azelate complex
- Magnesium soap complex
- Lead soap complex
- Sodium soap-sodium acetate complex
- Sodium soap-sodium acrylate complex
- Sodium-barium complex
- Strontium-calcium acetate complex Though the lubricating base oil component of the invention can be either a natural or synthetic oil, as a practical matter, the base oil will usually be a natural oil, e.g., a petroleum-derived mineral oil. Many synthetic oils such as silicone oils and various esters can be thickened effectively with soap thickeners; however, the thermal stability of soaps is usually considerably lower than that of the synthetic oils. Therefore, there is usually no point in using expensive synthetic oils with soap greases. Exceptions to this, however, are some of the complex greases which possess considerably higher thermal stability than the conventional soap-base greases.

The clays which are useful as thickeners for the preparation of greases are oleophilic clay products exhibiting a substantial base exchange capacity. The clays particularly contemplated herein include especially the montmorillonites, such as sodium, potassium, lithium, and the other bentonites, particularly of the Wyoming bentonite type. Still more preferred are the magnesium bentonites, sometimes referred to as "Hectorites." These clays are characterized by unbalanced crystal structure and are believed to have negative charges which are normally neutralized by inorganic cations. An especially preferred bentonite is that made by complexing finely particulated montmorillonite in aqueous media with dimethyldioctadecyl ammonium chloride using the techniques described in U.S. Pat. No. 2,531,427 and 2,531,440. This product can also be purchased under the coined name "Bentone 34" from the Baroid Sales Division of National Lead.

The term "oleophilic clay product" is meant to include such clays when they have absorbed thereon or reacted therewith sufficient organic ammonia base to form an oleophilic product. The so-called "onium-clays" comprise reaction products of oleophilic ammonium bases (or their salts) and clay.

The clays are more preferably modified by absorption of one or more oleophilic cationic surface-active agents such as those described in U.S. Pat. Nos. 2,831,809 and 2,874,152. The clays are preferably present in an amount sufficient to cause grease formation of the lubricating oil to occur. This will usually occur in the range of 2.5–10% by weight of the high base exchange clay (based on the inorganic clay portion of the oleophilic clay product) depending somewhat upon the precise clay employed, the chemical constitution of the major lubricating oil components and the proportions of other components present in the grease formulation.

The thickeners used in our invention normally comprise from about 3% to 10% of the grease.

The polyethylene which is one component of the synergistic additive combination of our invention is low density polyethylene. The density ranges from about 0.910 to 0.925 g/cc.

The other component in the synergistic extreme pressure additive combination of our invention comprises conventional extreme pressure additives. Such additives include but are not limited to molybdenum disulfide, lime, graphite, antimonydiamyldithiocarbamate, antimony dialkyldithiocarbamate and antimony phosphorodithioate.

The polyethylene may be present in an amount ranging from about 0.1to 3.0% of the grease. The conventional extreme pressure additive may be present in an amount ranging from about 1to 20% of the grease.

In addition to the additive combination of our invention, other additives of the types ordinarily employed in lubricating compositions may be employed in these greases, such as oxidation inhibitors, corrosion inhibitors and tackiness agents.

PREPARATION OF THE GREASE AND EXPERIMENTATION

The procedure for incorporating the polyethylene is to heat the oil to 150°–160°F and add the polyethylene. Heating is continued after the polyethylene is added until the temperature reaches 300°–310°F. This temperature is maintained while stirring until all the polyethylene has dissolved. After all of the polyethylene is dissolved, continued stirring and, if possible, circulation of the oil-polyethylene blend from the bottom of the blending kettle are maintained for one to three hours at 300°–310°F to assure uniform distribution of the polyethylene. After cooling to 150°–160°F, the clay thickener dispersant, additional oil and additives may be added as required to give the desired finished grease product. Alternately the clay thickener may be added prior to the polyethylene addition with equivalent results. Examples 1–4 illustrate the utility of the invention for greases and show the synergistic effect of the additive combination on EP properties (Timken test).

EXAMPLE 1

A clay thickened EP grease was prepared with and without polyethylene to give products of the composition and properties indicated below.

| Composition, Wt. % | | |
|---|---|---|
| Base Oil, 70 SUS/210°F | 79.04 | 77.25 |
| Bentone 34 Thickener | 6.96 | 7.00 |

-continued

| | | |
|---|---|---|
| Molybdenum Disulfide | 7.00 | 7.00 |
| Lime | 3.00 | 3.00 |
| Antimonydiamyldithiocarbamate | 4.00 | 4.00 |
| Polyethylene | — | 1.75 |
| Water (Added) | (0.70) | (0.62) |
| Test Results | | |
| Worked Pen. (D-217) | 373 | 385 |
| Timken, OK, Ld (D-2509) | 20 | 45 |
| Load Wear Index, Kg (ST-238) | 68.3 | 69.2 |
| Weld Point, Kg | 224 | 251 |
| Heat Stability | | |
| Worked Pen. Change | | |
| Per Cent after 24 Hr. | | |
| at 250°F +18 | | −6.5 |

EXAMPLE 2

A clay thickened grease having a higher viscosity base oil than the grease in Example 1 was prepared with and without polyethylene to give the product compositions and performance shown below.

| | | |
|---|---|---|
| Composition, Wt. % | | |
| Base Oil, 95 SUS/210°F | 80.08 | 78.31 |
| Bentone 34 Thickener | 5.92 | 6.15 |
| Molybdenum Disulfide | 7.00 | 7.00 |
| Lime | 3.00 | 3.00 |
| Antimonydiamydithiocarbamate | 4.00 | 4.00 |
| Polyethylene Resin | — | 1.54 |
| Water (Added) | (0.70) | (0.50) |
| Test Results | | |
| Worked Pen. (D-217) | 364 | 349 |
| Timken, OK, Lb (D-2509) | 25 | 50 |
| Load Wear Index | 74.4 | 70.3 |
| Weld Point, Kg | 251 | 316 |
| Heat Stability, Worked Pen. Change Per Cent after 24 Hr. at 250°F | +17 | +12 |

EXAMPLE 3

A clay thickened EP grease similar to those of Example 2, except that graphite was used in place of lime for antiwear properties, was prepared with and without polyethylene to give the product compositions and performance shown below.

| | | |
|---|---|---|
| Composition, Wt.% | | |
| Base Oil, 95 SUS/210°F | 80.48 | 81.20 |
| Bentone 34 Thickener | 5.52 | 4.20 |
| Molybdenum Disulfide | 7.00 | 7.00 |
| Graphite | 3.00 | 3.00 |
| Antimonydiamyldithiocarbamate | 4.00 | 4.00 |
| Polyethylene | — | 0.60 |
| Water (Added) | (0.50) | (0.42) |
| Test Results | | |
| Worked Pen. (D-217) | 363 | 352 |
| Timken, OK, Lb (D-2509) | 15 | 40 |
| Heat Stability, Worked Pen Change Per Cent after 72 hr. at 200°F | +8.9 | +3.1 |

EXAMPLE 4

| | | |
|---|---|---|
| Additives | | |
| Base Oil | 88.3 | 86.5 |
| Lithium Soap | 7.7 | 7.5 |
| Ashless Dithiocarbamate | 4.0 | 4.0 |
| Polyethylene | — | 2.0 |
| Test Results | | |
| Timken | | |
| OK, Lb (D-2509) | 30 | 40 |
| Score, Lb | 35 | 45 |
| Load Wear Index, Kg | 37.6 | 41.7 |
| Weld Point, Kg | 200 | 251 |

The above example shows that synergistic EP additive activity is obtained by adding polyethylene to a lithium soap thickened grease. Earlier data were for clay thickened greases.

All examples show that significant improvments in EP and heat stability properties are obtained by the addition of polyethylene. The polyethylene used meets the requirements for ASTM grade D-1248-1-A-4, i.e. density at 23°C of 0.910–0.925, natural color and a melt index of 0.4–1.0 g/10 minutes. However, it is expected that other polymers and grades of low density polyethylene may also be employed as long as they are completely soluble in the mineral oil to be used. The operable range of polymer is between 0.1 and 3.0 wt. % although 0.5 to 2.0 wt. % is preferred.

EXAMPLE 5

A lithium soap thickened grease was prepared with and without polyethylene to give the product compositions and performance shown below.

| | | |
|---|---|---|
| Composition, Wt. % | | |
| Base Oil | 90.4 | 91.7 |
| Li Soap | 9.6 | 7.2 |
| Polyethylene | — | 1.1 |
| Test Results | | |
| Worked pen. (D-217) | 253 | 260 |
| Timken, OK, Lb (D-2509) | 5 | 5 |

The above results show that the addition of polyethylene to a grease that does not already contain load carry additives does not improve EP properties as measured by the ASTM Timken Test. This indicates that the improvement shown in Examples 1 through 4 is the result of a synergistic effect between polyethylene and the EP/antiwear additives i.e. antimonydiamyldithiocarbamate, graphite, lime and molybdenum disulfide.

We claim:

1. A grease comprising
   a. a major amount of a lubricating oil,
   b. a thickener,
   c. polyethylene of density ranging between 0.910 and 0.925 g/cc and
   d. conventional extreme pressure agents.

2. A grease as in claim 1 wherein the conventional extreme pressure agents comprise molybdenum disulfide, lime, graphite and antimonydiamyldithiocarbamate.

3. A grease as in claim 1 wherein the conventional extreme pressure agents comprise molybdenum disulfide and antimonydiamyldithiocarbamate.

4. A grease as in claim 1 wherein the conventional extreme pressure agent comprises graphite.

5. A grease as in claim 1 wherein the conventional extreme pressure agents comprise molybdenum disulfide, graphite and antimonydiamyldithiocarbamate.

6. A grease as in claim 1 wherein the conventional extreme pressure agents comprise molybdenum disulfide, lime and antimonydiamyldithiocarbamate.

7. A grease as in claim 1 wherein the conventional extreme pressure agent comprises molybdenum disulfide.

8. A grease as in claim 1 wherein the conventional extreme pressure agent comprises lime.

9. A grease as in claim 1 wherein the conventional extreme pressure agent is anitmonydiamyldithiocarbamate.

* * * * *